US005150160A

United States Patent [19]

Masui

[11] Patent Number: 5,150,160

[45] Date of Patent: Sep. 22, 1992

[54] LIQUID ELECTROPHOTOGRAPHIC APPARATUS HAVING AN IMPROVED BACK ELECTRODE

[75] Inventor: Shin Masui, Kanagawa, Japan

[73] Assignee: Fuji Photo Film Co., Ltd., Kanagawa, Japan

[21] Appl. No.: 676,589

[22] Filed: Mar. 28, 1991

[30] Foreign Application Priority Data

Apr. 2, 1990 [JP] Japan ..... 2-88068

[51] Int. Cl.[5] ..... G03G 15/10

[52] U.S. Cl. ..... 355/256; 355/261; 118/650; 118/659

[58] Field of Search ..... 355/256, 261-264; 118/659, 660, 647, 650

[56] References Cited

U.S. PATENT DOCUMENTS 3,871,329 3/1975 Anemaet ..... 118/650
5,081,499 1/1992 Nakao et al. ..... 355/256

FOREIGN PATENT DOCUMENTS 56-14525 4/1981 Japan .
58-4165 1/1983 Japan ..... 355/256
61-11766 1/1986 Japan .

*Primary Examiner*—Joan H. Pendegrass
*Attorney, Agent, or Firm*—Sughrue, Mion, Zinn, Macpeak & Seas

[57] ABSTRACT

A liquid electrophotographic apparatus in which a photoconductive material over the surface of which is formed an electrostatic latent image is inserted between a developing electrode and a back electrode and a liquid toner is supplied, thereby developing the electrostatic latent image. The back electrode is made of an electrically conductive material having a three-dimensional structure and is brought into contact with the back surface of the photoconductive material, whereby electrical attachment of the toner particles to the back electrode can be prevented.

8 Claims, 10 Drawing Sheets

LIQUID ELECTROPHOTOGRAPHIC APPARATUS HAVING AN IMPROVED BACK ELECTRODE

BACKGROUND OF THE INVENTION

1. Field of the Invention

The present invention relates to a liquid electrophotographic apparatus of the type in which a liquid toner is supplied over the photoconductive surface of a photoconductive material over which is formed an electrostatic latent image so that the latter is developed.

2. Description of the Related Art

So far there has been proposed liquid electrophotographic apparatus in which a liquid toner (comprising toner particles, an electric-charge adjusting agent, a dispersion agent and so on) is supplied over a photoconductive material such as an ELP master (comprising a lamination of a photoconductive layer comprising a photoconductive layer ZnO, a binder and a substrate which has been so processed as to be water-proof and electrically conductive), thereby developing an electrostatic latent image formed over the surface of the master.

In the electrophotographic apparatus of the type descibed above, an electrode pair consisting of two metal plates disposed in opposing relationship with each other and being spaced apart from each other by a desired distance (one of the metal plates, in opposing relationship with the photoconductive layer surface of the photoconductive material, is referred to as "a developing electrode", while the other metal plate, in opposing relationship with the back surface of the photoconductive material, is referred to as "a back plate", hereafter in this specification) is disposed, and a bias voltage applied between the electrode pair is short-circuited while the liquid toner is being supplied therebetween, and when the above-described master is passing therebetween, thereby developing the electrostatic latent image formed over the surface of the photoconductive layer.

When the liquid toner is supplied to the master passing between the electrode pair, the toner particles contained in the liquid toner are attracted by and adhere to the electrically charged particles forming an electrostatic image, whereby the latent image is made visible.

However, in the case of the conventional wet type photographic apparatus of the type described above, in response to the neutralization of the latent-image forming charged particles covering the surface of the master by the toner particles in the developing liquid, a charge is induced over the rear surface of the photoconductive layer of the photoconductive material, causing the charging of particles whose polarity is opposite to that of the charged particles over the photoconductive layer; that is, charged particles whose polarity is opposite to that of the toner particles, so that some toner particles adhere to the back electrode, thereby contaminating it.

A further problem resides in the fact that as the number of development operations increases, the quantity of the toner particles attached to the back electrode increases accordingly so that a nonelectrically conductive film is formed over the surface of the back electrode. Such a nonelectrically conductive film over the back electrode prevents the movement of the charged particles so that when the developing process is repeated many times, the film thus formed becomes electrically conductive because of the attachment thereto of the charged particles. As a result, the adhesion of the toner particles over the photoconductive surface is adversely affected, resulting in a decrease in the density of the image developed.

Furthermore, as the thickness of the layer of charged particles is increased, the layer breaks up into solid particles which in turn become attached to one or more portions of the master where no latent image is formed so that the toner particles on the surface of the master are contaminated.

In order to solve this problem, as best shown in FIG. 11. It has been proposed that the back surface of the substrate of the master be supported by a plurality of projections produced by roughening the surface of the back electrode. (Reference is made to Japanese Patent Application Laid-Open No. 61-11766.) In addition, a construction has also been proposed in which, as best shown in FIG. 12, an electrically conductive wire net is used as the back electrode. (Reference is made to Japanese Utility Model Application Publication No. 56-14525.) According to the above-described technique, the back electrode is brought into contact with the back surface of the master substrate so that the charged particles attached to the back electrode can be neutralized by those attached to the substrate, and so that the quantity of toner particles attached to the back electrode can be decreased.

However, the portions which are not brought into contact with the back surface of the substrate, but are instead spaced apart therefrom by a small distance or gap, so that the electric field produced between the back surface of the substrate and portions of the back electrode not in contact with the back surface of the substrate is increased, and the toner positively charged particles easily become attached to the back electrode (such a space left because of the noncontact relationship between the back electrode and the back surface of the substrate is referred as "a gap" hereinafter in this specification).

In the case of a back electrode whose surface is roughened, the discharge of the developing liquid between the back electrode and the master becomes difficult as a result of the many such "gaps" and a liquid film is formed on the surface thereof so that positive contact between the back electrode and the substrate cannot be achieved, resulting in the electrical attachment of positively charged particles to the back electrode.

In the case of the use of an electrically conductive wire net, it is difficult to maintain the wire net in the form of a flat surface, and thus, out of contact portions tend to occur frequently and the quality of the developed image cannot be stably and reliably ensured; that is, the quality is degraded. Even when a supporting member is provided, in order to maintain the flatness of the wire net, the liquid film is still formed in the manner described above, resulting in the same problem.

Japanese Patent Application Laid-Open No. 58-4165 discloses the disposing of the developing electrode in opposed relationship with the photoconductive layer from a foamed metal. According to this teaching, the primary object is to enable a lot of developing liquid to flow between the photoconductive layer and the developing electrode, by utilizing the fact that the degree of porosity of a foamed metal is generally high. In addition, the developing liquid is supplied from the side of the developing electrode so that the contact between the developing electrode and the photoconductive material is prevented. However, the back electrode is substantially similar in construction to the conventional back electrodes so that the attachment of the toner particles to the back electrode cannot be avoided.

The back electrode must be cleaned at a predetermined time interval, when a certain amount of developing liquid has passed over the photoconductive substrate, or, the material must be removed in the case of abnormal operation or the like. Furthermore, in the case of the conventional liquid electrophotographic apparatus, the developing stage must be completely disassembled. Because of these reasons, the maintenance of the electrophotographic apparatus is difficult, and the apparatus is not reliable and dependable. In addition, a further problem occurs when the photoconductive material is guided to the developing stage, namely, the back of the photoconductive material is contaminated by toner particles or the like attached to the guide surfaces.

SUMMARY OF THE INVENTION

The present invention was made to solve the above-mentioned problems and has as its primary object the provision of a liquid electrophotographic apparatus which can maintain toner concentration over the photoconductive surface of a photoconductive material; while at the same time reducing the quantity of the toner attached to a back electrode to a minimum, and which can facilitate the transportation of the photoconductive material through the electrophotographic apparatus.

Another object of the present invention is to provide a liquid electrophotographic apparatus in which the attachment and detachment of the back electrode is facilitated so that the maintenance of the electrophotographic apparatus is facilitated.

A further object of the present invention is to provide an electrophotographic apparatus which, in addition to attaining the above-mentioned objects, can positively prevent the contamination of the back surface of the photoconductive material.

In order to attain the above-mentioned objects, a liquid electrophotographic apparatus in accordance with the present invention is equipped with a developing electrode disposed in opposing and spaced-apart relationship with a first surface of a photoconductive material upon which is formed an electrostatic latent image; and a back electrode which is brought into contact with a second surface of the photoelectric material and is disposed in opposing relationship with the developing electrode. The developing electrode is made of an electrically conductive material having a three-dimensional net structure interconnected to defined a flat surface on those portions thereof which are in contact with the second surface of the electrically conductive material.

The photoconductive material over which is formed an electrostatic latent image in accordance with the present invention is developed by a liquid toner when the photoconductive material is tranported between the developing and the back electrodes, in contact with the back electrode. As a result, while the charges forming a latent image over the photoconductive surface of the photoconductive material are neutralized by the toner particles contained in the liquid toner the charges which are present over the second surface of the photoconductive material (opposite to the first surface of the photoconductive material), and which have the opposite polarity with respect to the charges over the first surface of the photoconductive material, flow to the back electrode and are neutralized along with the charges flowing from the developing electrode to the back electrode.

When the photoconductive material is transported between the developing and back electrodes, the second surface of the photoconductive material must be slid over the back electrode while in contact therewith so that the flow of charges can be facilitated. To this end, according to the present invention, the back electrode is made of an electrically conductive material having a three dimensional net structure. Furthermore, the portions of the back electrode which are brought into contact with the second surface of the photoconductive material define a flat surface. Since the back electrode in accordance with the present invention has a three-dimensional net structure, the portions thereof brought into contact with the second surface of the photoconductive material are in the form of wire as shown in FIG. 10, so that the area of the portions in contact with the second surface of the photoconductive material is small. In addition, the distance between each of the out-of-contact portions of the back electrode and the second surface of the photoconductive material is considerably longer than those which would occur in the case of an electrically conductive wire net in contact with an electrode whose surfaces are roughened, and thus, the electric field strength at the out of contact portions is remarkably weak. As a result, the area over which the toner particles become electrically attached is small and also the electrostatic adhesion force is small. As a consequence, it becomes possible not only to reduce the quantity of attached charged particles but also to facilitate the smooth transportation of the photoconductive material.

Furthermore, since the back electrode in accordance with the present invention has a three-dimensional net structure, the liquid toner which flows over the second surface of the photoconductive material flows through the back electrode so that no liquid film remains and consequently the positive electrical contact can be ensured. Moreover, since the back electrode is in the form of a three dimensional structure, it can have a degree of rigidity sufficient to maintain flatness so that the uniform contact can be ensured. The surface of the back electrode is substantially flat so that the photoconductive material which slides thereover in contact therewith encounters almost no resistance and the photoconductive material can be so supported as to maintain a predetermined gap between the developing electrode and the photoconductive material, whereby an image pattern can be developed with a high degree of accuracy.

The thickness of the back electrode is greater than $\frac{1}{3}$ of the distance between the developing and back electrodes and it is preferable that the average diameter of the electrically conductive material be less than $\frac{1}{3}$ of the average net pitch so as to allow the smooth flow of the liquid toner therethrough.

According to the present invention, it is possible to provide an attachment means by which the back electrode can be detachably attached to a back-electrode supporting frame. In this case, when maintenance procedures such as washing of the back plate are carried out, the back plate can be detached in a simple manner. Thus, the maintenance of the electrophotographic apparatus in accordance with the present invention can be greatly facilitated. In addition, since the back electrode is attached to the supporting frame, it is not necessary to enlarge the area of the back electrode any more than is necessary, and thus the liquid electrophotograhic apparatus in accordance with the present invention can be produced at a lower cost.

Furthermore, in accordance with the present invention, it is possible to provide a guide means on the photoconductive material inlet side of the supporting frame in order to guide a photoconductive material transported between the developing and back electrodes. When the guide means is made of an electrically conductive material having a three-dimensional net structure and is constructed integrally with the back electrode, all the portions which are brought into contact with the photoconductive material become electrically conductive materials in the developing stage, each having a three-dimensional net structure, so that the contamination of the rear surface of the photoconductive material can be positively prevented.

As described above, the liquid electrophotographic apparatus in accordance with the present invention can attain the excellent effects that the toner concentration over the photoconductive surface of the photoconductive material can be uniformly maintained; the quantity of the toner particles attached to the back electrode can be reduced to a minimum; and the smooth transportation of the photoconductive material through the electrophotographic apparatus can be ensured.

In addition, the attachment and detachment of the back electrode is facilitated so that the maintenance can be carried out in a simple and quick manner. Furthermore, the contamination of the photoconductive material can be positively prevented.

DETAILED DESCRIPTION OF THE PREFERRED EMBODIMENT

Figure 1:
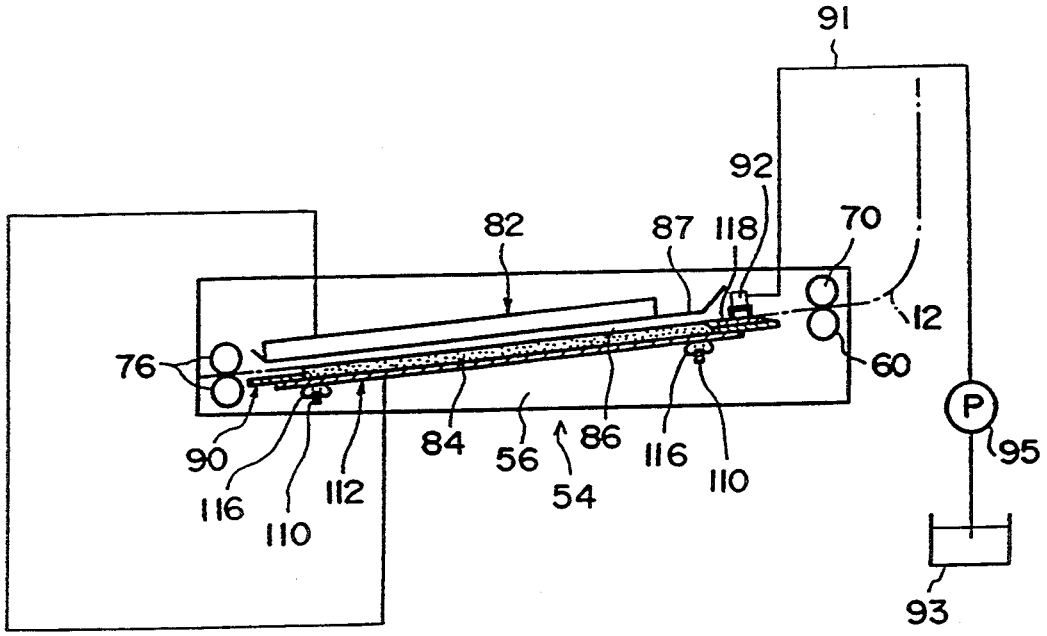
FIG. 1 is a side view of a developing stage of a liquid electrophotographic apparatus in accordance with the present invention.
Figure 3:
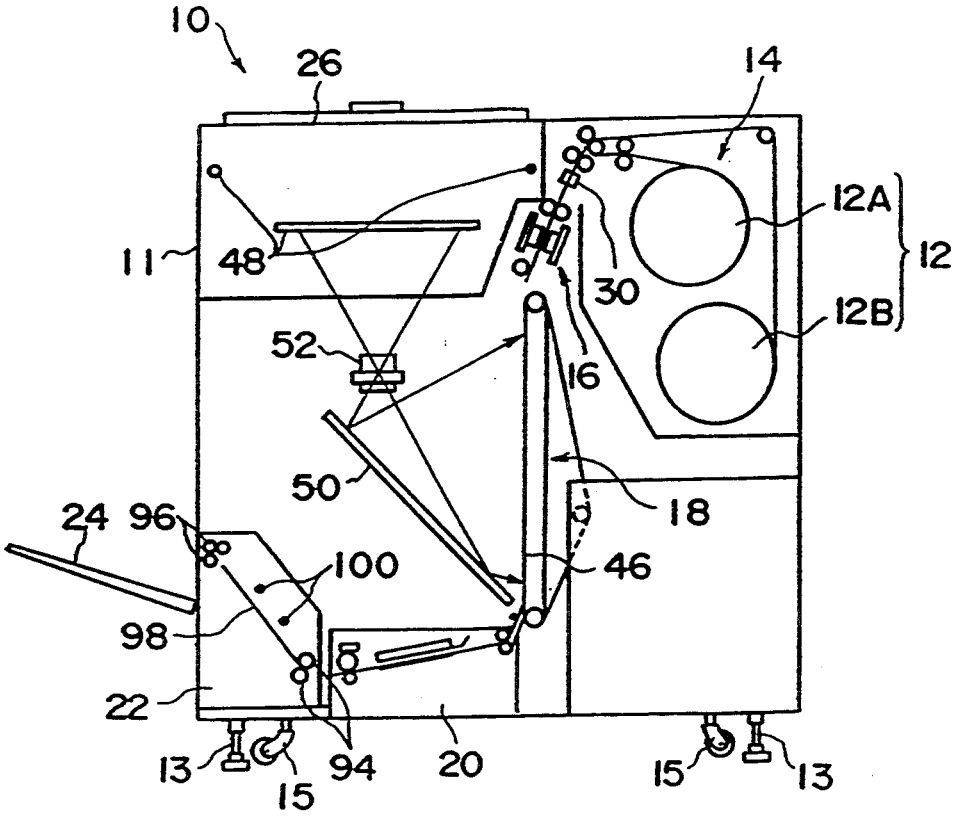
FIG. 3 is a schematic view illustrating the whole construction of a liquid electrophotographic apparatus to which the present invention is applied.

FIG. 3 is a liquid electrotophotographic apparatus 10 to which is applied the present invention, while FIG. 1 is a schematic side view of a development stage thereof.

As best shown in FIG. 1, the liquid electrophotographic apparatus has a rectangular cross section and its opening is closed with a cover 11. The liquid electrophotographic apparatus 10 has four legs 13 attached at the four corners of the bottom so that the apparatus 10 may be placed on a floor. Furthermore, four casters 15 are attached to the bottom of the apparatus 10 adjacent to the legs 13, respectively, so that the apparatus 10 may be moved to a desired position.

As shown in FIG. 3, liquid electrophotographic apparatus 10 is closed with the cover 11 to define the interior of the apparatus 10, which has a paper feed section 14 in which is loaded a long photoconductive material (to be referred hereinafter as "a master" in the specification) 12 in the form of a roll.

Figure 4:
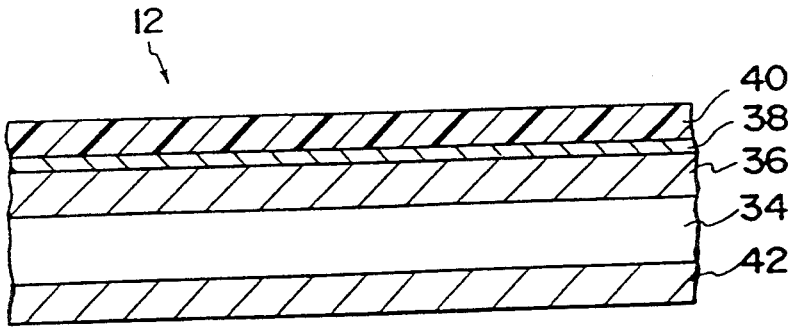
FIG. 4 is a sectional view of a master.

As shown in FIG. 4, the master 12 used in this embodiment comprises a substrate 34 made of paper 34 on which are laminated a photoconductive water-proof layer 36, an intermediate layer 38 and a photoconductive layer (ZnO) 40 in the order mentioned. An electrically conductive water-proof layer 42 is also bonded firmly to the back surface of the substrate 34. The substrate 34 is about 175 microns in thickness while the photoconductive layer 40 is about ten microns in thickness. The surface resistance of the electrically conductive water-proof layer 36 is of the order of $10^8$–$10^{11}$ ohms. In FIG. 3, two master rolls 12A and 12B are shown as being loaded in the paper feed section 34 and are different in size (width) from each other.

Referring back to FIG. 3, disposed on one side of the feed section 14 is a charging stage 16 which charges the surface of the master drawn out from the feed section 14. An exposure stage 18 is disposed on the lower side of the charging stage 16. A cutter 30 is disposed between the charging stage 16 and the paper feed section 14 so that a predetermined length of the master 14 withdrawn from the paper feed section 14 is cut off.

An exposure stand 46 is installed vertically in the exposure stage 18. The surface of the exposure stand 46 is formed with a plurality of suction holes which are in communication with a negative pressure supply means (not shown) so that negative pressure is supplied to the suction holes. A master 12 whose surface has been charged in the charging stage, and which has been cut off at a predetermined length is transported over the surface of the exposure stand 46, the surface of the exposure stand 46 by means of the suction holes over the surface thereof. Furthermore, disposed within the exposure stage 46 are one or more exposure lamps 48 which illuminate the surface of an original placed on an original stand 26, a mirror 50 which reflects light emitted from the exposure lamp 48, to the exposure stand 46, and a lens 52 interposed between the original stand and the mirror 50.

Light emitted from the exposure lamps 48, therefore, illuminates the image pattern placed on the original stand 26 and light reflected by the image pattern is transmitted through the lens 52 and the mirror 50 to the master 12 placed over the exposure stand 46, whereby the master 12 is exposed.

A developing stage 20 is disposed below the exposure stage 18. And a developing box 54, best shown in FIGS.

1 and 2, is disposed within the developing stage 20. It is in the form of a box whose top and one side are open. A feed roller 60 extends between the opposite side walls 56 and 58 of the developing box 54, on the side thereof having the inlet for the master 12, and both ends of the feed roller 60 are rotatably supported by the side walls 56 and 58, respectively. A gear 62 and a sprocket wheel 64 are securely supported by the end portion of the feed roller 60 supported by the side wall 56.

The feed roller 60 extends through the side wall 56 and carries a spocket wheel 66 at the end thereof. The sprocket wheel 66 is drivingly connected through an endless chain 68 to a sprocket carried by the driving shaft of a motor (not shown) so that the rotary driving force of the motor is transmitted to the feed roller 60, causing it to rotate.

A comb-shaped roller 70 is disposed above the feed roller 60 in contact relationship therewith, and the two ends of the roller 70 are respectively supported by the side walls 56 and 57, through bearings (not shown). The comb-shaped roller 70 carries a gear 74 on the end supported by the side wall 56, which in turn meshes with the gear 60 of the feed roller 60. The driving force transmitted to the feed roller 60 is thus transmitted to the comb-shaped roller 70.

A pair of feed rollers 76 extend between the side walls 56 and 58 of the developing box 54, in opposite relation to the feed roller 60; that is, on the side of developing box 54 having the outlet for the master 12.

A spocket wheel 78 is securely supported on the lower feed roller 76 at the end thereof supported by the side wall 56, which in turn drivingly connected to the spocket wheel 64 supported on the feed roller 60, so that the driving force transmitted to the feed roller 60 is transmitted to the pair of feed rollers 76. The master 12 transported from the exposure stage 18 is clamped between the feed roller 60 and the comb-shaped roller 70 and is transported toward the pair of feed rollers 76 in a downwardly inclined direction.

A developing electrode 82 and a back roller 84 are disposed between the feed roller 60 and the comb-shaped roller 70 on the one hand and the feed roller pair 76 on the other hand and they are downwardly inclined in the direction of the feed roller pair 76. A space 86 is defined between the developing and back electrodes 82 and 86 and the master 12 emerging from the gap between the feed roller 60, and the comb-shaped roller 70 is directed in a downwardly inclined direction through the space 86 and is inserted between the feed roller pair 76.

The developing electrode 82 is made of a metal plate and is disposed in opposing relationship with the photoconductive surface of the master 12; that is, it is disposed above the space 86. The back electrode 84 is disposed in opposing relationship with the electrically conductive water-proof layer 42 of the master; that is, it is disposed on the lower side of the master transportation passage or the space 86. The back electrode 84 is disposed within a rectangular opening 90A defined at the center portion of the back plate 90 disposed within the developing box 54, which is a frame structure. Four outwardly threaded screws 110, which are components of a detachment means, extend downward from the four corners of the supporting plate 112 and respectively extend through round holes 114, to threadably engage with nuts 116, which are also components of the detachment means, whereby the suppporting plate 112 is securely attached to the back plate 90.

The back plate 90 is slightly bent in the direction in which the inlet of the master 12 is spaced apart from the developing electrode 82, and a guide plate 118 which guides the inserted master 12 between the developing and back electrodes 82 and 84 is bonded at a bent or curved portion in coplanar relationship with the back electrode 84.

Figure 5:
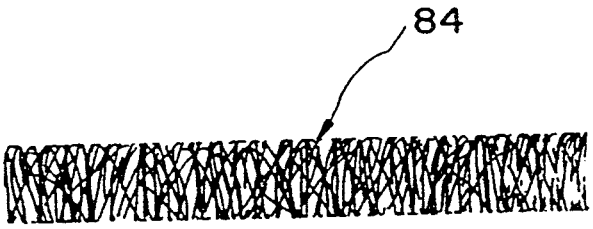
FIG. 5 is a sectional view of a foamed metal.
Figure 10:
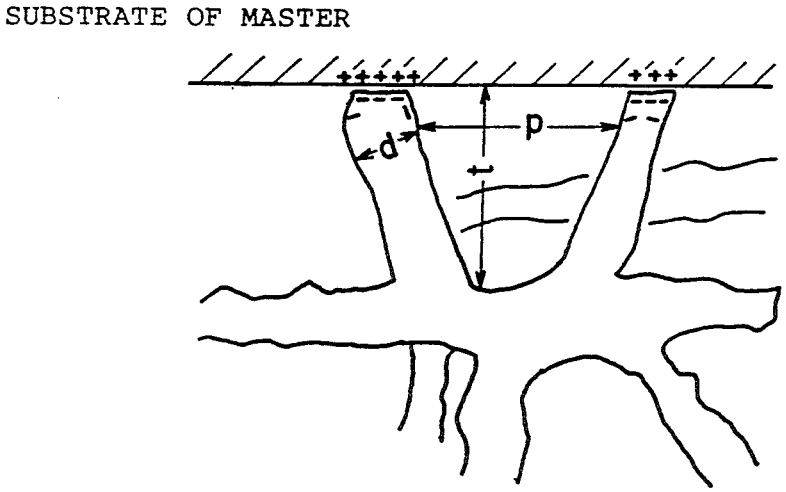
FIG. 10 is a view illustrating, on an enlarged scale, a portion of the foamed metal plate shown in FIG. 5.
Figure 11:
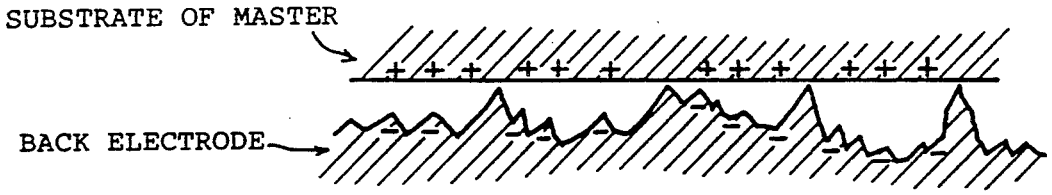
FIG. 11 PRIOR ART
FIG. 11 is a schematic view, partly enlarged in scale of a portion of the roughened surface of a conventional electrode.
Figure 12:
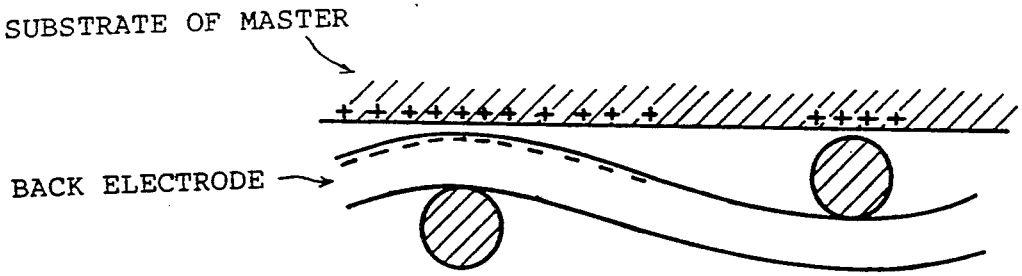
FIG. 12 PRIOR ART
FIG. 12 is a schematic view, partly enlarged in scale, illustrating a conventional flat wire net electrode.

The back electrode 84 is made of a foamed metal plate which is an electrically conductive material having a three-dimensional net-like structure, best shown in FIG. 5 and FIG. 10, which are enlarged views of FIG. 5. That is, the electrically conductive metal plate (the back electrode 84) has a three-dimensional net structure and has a large number of holes or pores extending through the plate so that the upper and lower surfaces exhibit microscopically rough surfaces, but the diameters of the holes or pores are extremely small, (high density) so that both the upper and lower surfaces exhibit macroscopically flat surfaces. In other words, the interface between the back surface of the master 12 and the electrically conductive metal plate is flat. This macroscopically flat surface means that the resistance encountered by the master 12 transported over the surface of the back electrode 84 is less than the degree of resistance encountered when the master 12 is slidably transported over an ordinary flat surface. In order to determine the sliding resistance within a predetermined range as described above, it suffices that the number of cells of a foamed metal plate be 5–100 cells/inch and more preferably 20–50 cell/inch. In other words, it suffices that the average diameter d of an electrically conductive material be less than one third of the average net pitch p as best shown in FIG. 10. Furthermore, the average distance t between the portion in contact with the back surface of the master 12 of the electrically conductive material and the portion not in contact with the back surface of the master 12 is so determined that the adhesion of toner particles can be prevented by the electric field produced between the back surface of the master 12 and the noncontact portion of the material.

Such a foamed metal plate (the back plate 84) which can be used in the present invention is "Cellmet" (the trade mark of the product of SUMITOMO DENKI KOGYO KABUSHIKI KAISHA) now available on the market. Depending on the number of cells and the specific surface area, several kinds of "CELLMET" are available and in this embodiment "the product #4" with the cell number of 26–35 cells/inch and the specific surface area of 2,500 $m^2/m^3$ is used.

As best shown in FIG. 1, the guide plate 118 of the foamed metal (the back electrode 84) decreases in thickness toward the sides thereof. As a result, problems such as the engagement, of the master 12 being guided by the guide plate 118, with the side edges of the foamed metal (the back electrode 84) can be avoided, so that the master 12 can be smoothly transported. The foamed metal plate has a sufficient thickness so that the liquid toner can flow therethrough. It is preferable that the thickness be more than one third ($\frac{1}{3}$) of the gap between the developing and back electrodes.

The foamed metal plate (the back electrode 84) as shown in FIG. 1 is short-circuited with the developing electrode 82 so that when the master 12 which has been charged passes through the gap 86 between the developing and back electrodes 84 and 86, an electric field is produced therebetween and charges of opposite polarity are induced on the respective electrodes.

Figure 2:
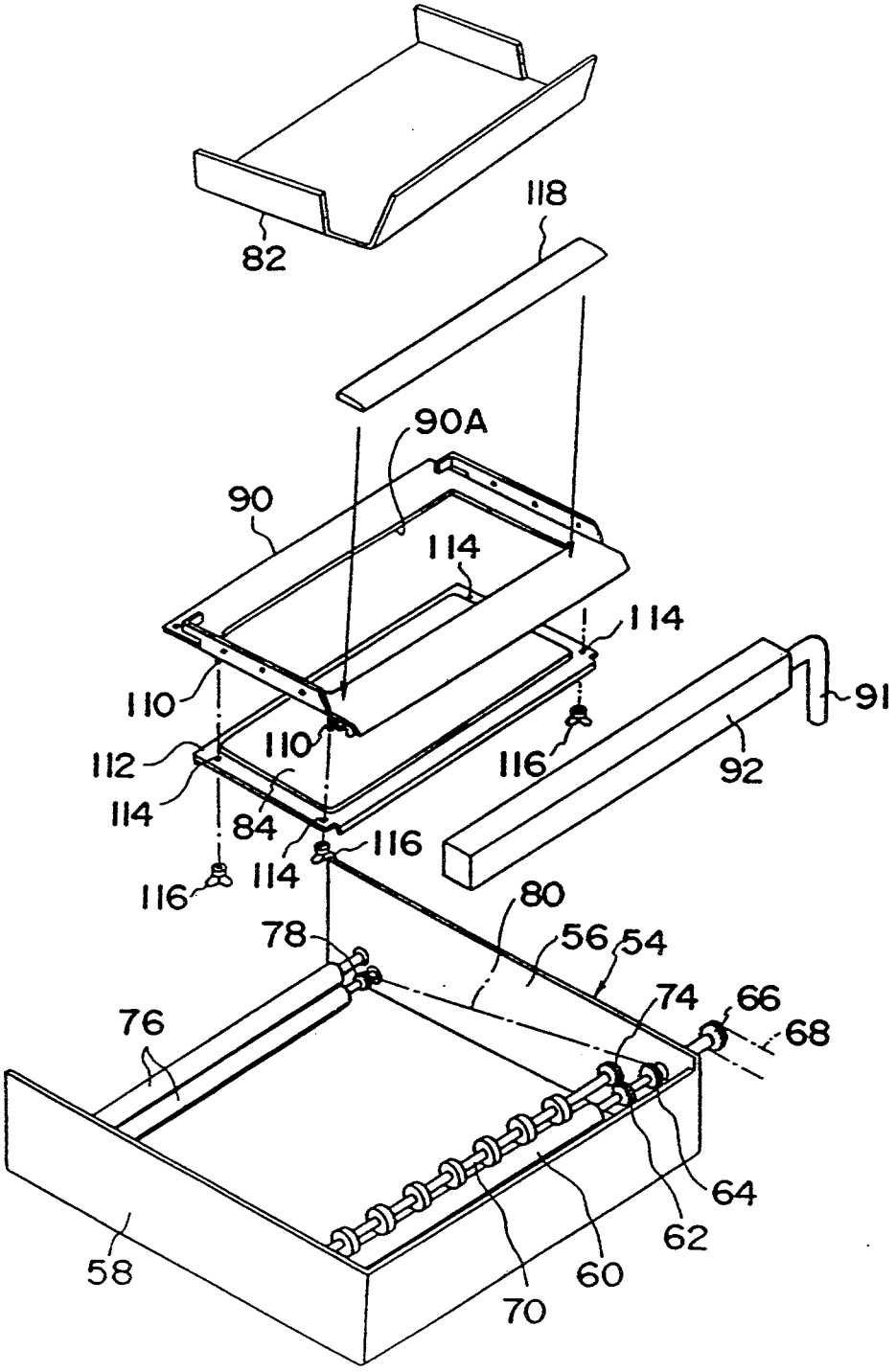
FIG. 2 is an exploded perspective view thereof.

As shown in FIG. 2, a liquid toner supply box 92 is interposed between the developing electrode 82 and the comb-shaped roller 70 over the guide plate 118. The liquid toner supply box 92 is in communication through a line 91 with a liquid toner tank 93 (see FIG. 1) and a feed pump 95 is inserted in the supply line 91. When the feed pump 95 is energized, the liquid toner is supplied into the liquid toner supply box 92. The liquid toner supply box 92 is provided with a liquid toner discharge opening directed to the gap between the developing and back electrodes 82 and 84 in the widthwise direction of the master 12. It follows therefore that the liquid toner is discharged through the toner discharge opening onto the developing electrode 8 and the photoconductive surface of the master 12 which is transported in the downwardly inclined direction.

As best shown in FIG. 3, a fixing stage 22 is disposed on one side of the developing stage 20 and is equipped with a feed roller pair 94 on the side of the developing stage 20. The master discharged from the developing stage 20 is inserted between the feed rollers 94.

A feed roller pair 96 is disposed in one fixing stage 22 on the side thereof having the outlet for the master 12, at positions higher than the feed roller pair 29. A guide 98 extends between the feed roller pair 96 and the feed roller pair 94 and is inclined upwardly from the feed roller pair 94 to the feed roller pair 96. Two lamps 100 are disposed above the guide 98 so that the master 12 guided by the guide 98 from the feed roller pair 94 in the upwardly inclined direction is heated and fixed by the lamps 100. A tray 24 is disposed at the outside of the feed roller pair 96 and receives the master 12 fed by the feed roller pair 96.

Next the mode of operation of the embodiment with the above described construction will be described in detail hereinafter.

The master 12 which is loaded in the paper feed section 24 is unrolled and drawn into the charging stage 16 in which the surface of the master 12 is uniformly charged. Thereafter the charged master 12 is fed over the exposure stand 46 in the exposure stage 18 and when the charged master 12 reaches the point of covering the exposure stand 46, it is cut off at a predetermined length by the cutter 30.

The charged master 12 which is cut at a predetermined length is held by suction over the surface of the exposure stand 46. Thereafter the light rays emitted from the exposure lamps 48 illuminate a pattern image (not shown) of an original placed over the original stand 26 and the light rays reflected back from the image pattern are projected over the charged master 12 through the lens 52 and from the reflecting mirror 50 so that the charged master on the exposure stand 46 is exposed, whereby an electrostatic latent image is formed over the charged surface of the master 12.

Next the exposed master 12 is inserted between the feed roller 60 and the comb-shaped roller 70 in the developing stage and then into the gap 86 between the developing and back electrodes 82 and 84. Then liquid toner is supplied over the exposed surface of the master 12 from the liquid toner supply box 82.

The rear surface of the master 12 inserted in the gap between the developing and back electrodes 82 and 84 is brought into contact with the foamed metal plate (back electrode 84) to slide in a downwardly inclined direction toward the feed roller pair 76.

When the master 12 passes through the gap between the developing and back electrodes 82 and 84, electric fields are produced between the exposed surface of the master 12 and the developing electrode 82 and between the back surface of the master 12 and the back electrode 84 by electrostatic induction. Then the toner particles which are charged positively in the electric field are attracted by the electrostatic latent image defined by the negatively charged electrostatic image over the exposed surface of the master 12, so that the electrostatic latent image is developed to become a toner image.

Figure 6:
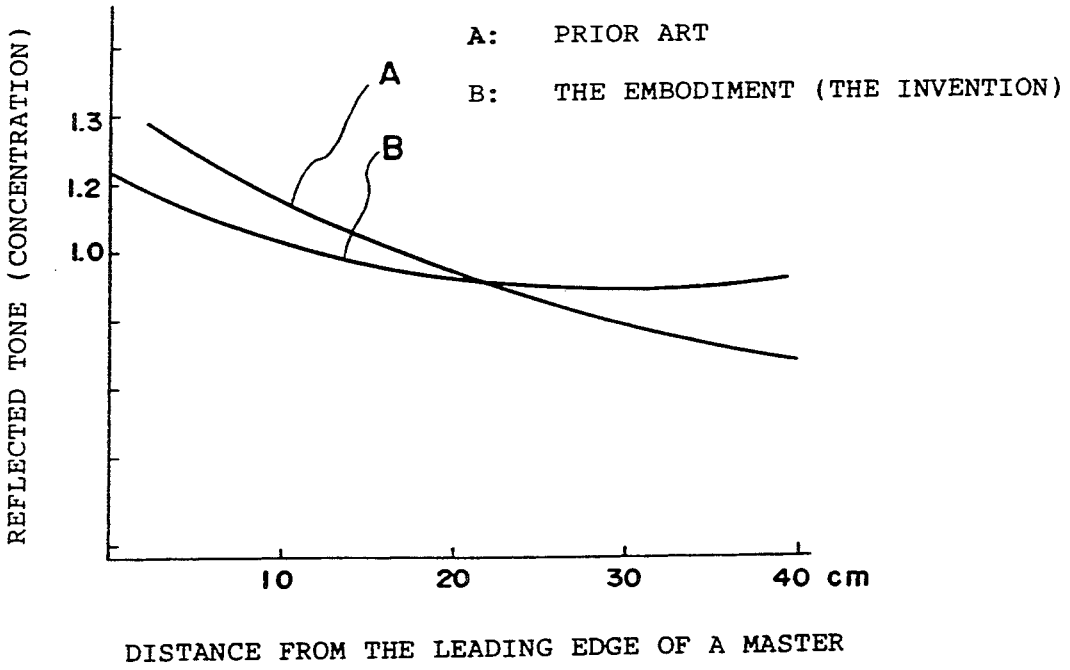
FIG. 6 is a characteristic diagram illustrating the results of a comparison made between a conventional liquid electrophotographic apparatus and a wet type electrophotographic apparatus in accordance with the present invention in order to compare the variations in reflected tone when the same master is processed.

In this case, the surface of the back electrode 84 is negatively charged, but the whole foamed metal plate (back electrode 84) is electrically conductive and the rear surface of the master is brought into contact with the leading edges (projections) of the foamed metal plate (back electrode 84) so that the positive and negative charges are neutralized (See FIG. 10). Furthermore, the toner particles are guided so as to enter the recesses or holes of the foamed metal plate so that no liquid film is left on the surface of the back electrode 84 and accordingly the quantity of the toner particles attached to the back electrode 84 is reduced. As a result, the back electrode 84 and the master 12 are always maintained in an electrically connected state so that the quantity of toner particles attached to the exposed surface of the master can be maintained uniformly so that the tone of the master 12 can be maintained substantially uniform. In addition, the distance between each portion in contact with the rear surface of the master 12 of the foamed metal plate on the one hand and each portion not in contact with the rear surface of the master 12 on the other hand is long, so that the electric field intensity is less, and accordingly, the electrical attachment of the toner particles can be prevented. In order to investigate the above-mentioned effect, the results of development carried out by using a conventional grooved back electrode (indicated by the arrow A) are compared with the results of development carried out by using the foamed metal plate (CELLMET, the product #4) used in this embodiment (indicated by the arrow B) as shown in FIG. 6. It should be noted here that in the experiments conducted by the inventors, the toner particles were attached to the whole surfaces of the masters.

According to the results of such experiments, the reflected tone at the lending edges of the masters developed by using the conventional back electrode and the foamed metal plate (the back electrode) according to the present invention is of the order of 1.3, but when the conventional back electrode was used, the reflected tone gradually decreases toward the trailing edge of the master. It should be noted that the reflected tone was decreased on the order of 0.3 at a point spaced apart by 30 cm from the leading edge when the development was carried out by using the conventional back electrode, but when the foamed metal plate was used in accordance with the present invention, the decrease in reflected tone was reduced to less than 0.1.

Figure 7:
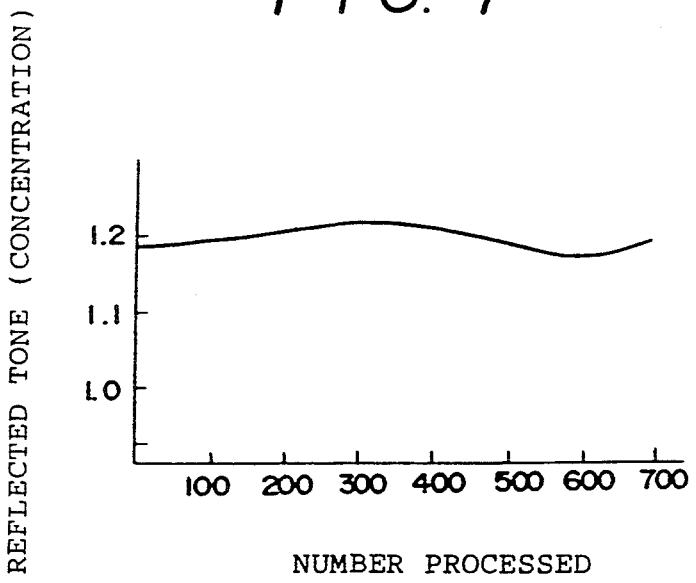
FIG. 7 is a graph illustrating the relationship between the number of masters processed and the reflected tone.
Figure 8:
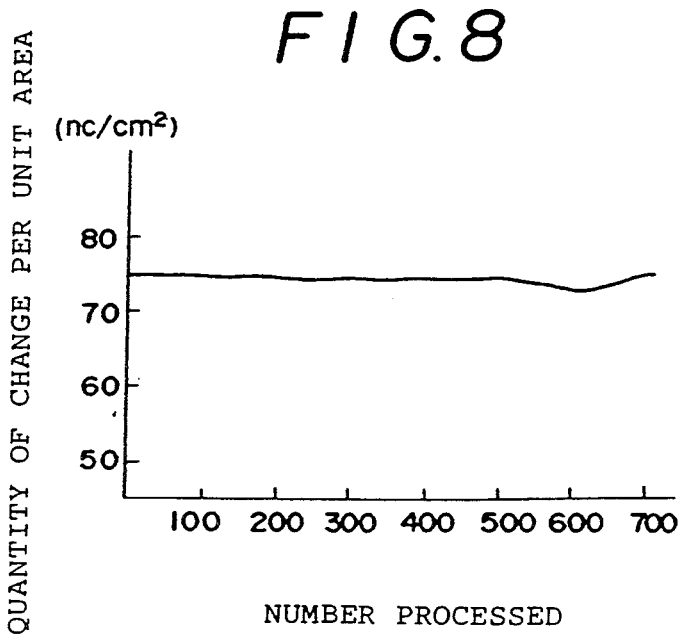
FIG. 8 is a characteristic graph illustrating the relationship between the number of masters processed and the quantity of charged particles contributing to the development of a unit area thereof in the case of development.

Furthermore, it is seen from FIG. 7 illustrating the number of masters developed vs. the reflected tone and FIG. 8 illustrating the characteristic relationship between the number of masters developed and the required quantity of electric charge per unit area, namely, that even when the number of masters developed is increased, the reflected tone and the quantity of electric charge per unit area can be maintained substantially constant.

The master 12 developed in the developing stage 20 is fed into the fixing stage 22 so that the toner particles forming a toner image over the surface of the master 12 and heated and fixed. The fixed masters 12 are collected in the tray 24.

The back electrode 84 must be cleaned and/or replaced after a predetermined period has passed. In such a case, the nuts 116 are unscrewed from the outwardly threaded threaded screws 110 so that not only the supporting plate 112 but also the back electrode 84 can be easily removed from the back plate 90. As a result, the maintenance of the back electrode can be much facilitated. After washing the back electrode 84, the outwardly threaded screws 110 are inserted through the round holes 114 and threadably engaged with the nuts 116. Thus, the attachment and detachment of the back electrode 84 are very simple. Therefore, in the case of malfunction such as jamming of the master 12, a suitable countermeasures can be quickly carried out.

Figure 9:
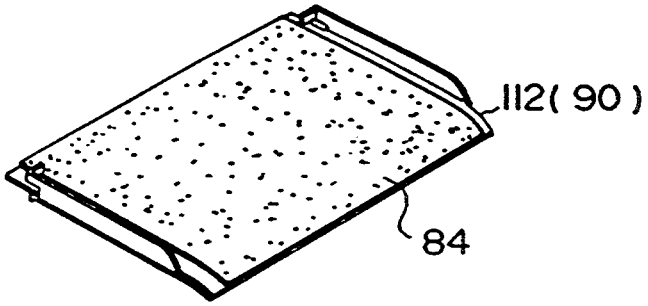
FIG. 9 is a perspective view illustrating a back plate comprising the integral construction of a back electrode and a guide plate using foamed metal plates.

In the embodiment, the back electrode 84 has been described as being disposed only in opposing relationship with the developing electrode 82, but, as shown in FIG. 9, when the guide plate 118 and the back electrode 84 are made of a foamed metal plate with a unitary construction, the whole surface in contact with the master 12 becomes the foamed metal plate so that the contamination of the master 12 can be reduced to a minimum. In this case, the back plate 90 may be replaced by the supporting plate.

What is claimed is:

1. A liquid electrophotographic apparatus, comprising:

a developing electrode in opposing and spaced-apart relationship with a first surface of a photoconductive material upon which is formed an electrostatic latent image; and a back electrode which is brought into contact with a second surface opposite to said first surface of said photoconductive material disposed in opposing relation to said developing electrode, and made of an electrically conductive material having a three-dimensional net structure, whose portions in contact with said second surface of said photoconductive material define a macroscopically flat surface wherein the thickness of said back electrode is greater than ⅓ of the distance between said developing and back electrodes.

2. A liquid electrophotographic apparatus according to claim 1, wherein the average diameter of said electrically conductive material is less than ⅓ of the average pitch of said net structure.

3. A liquid electrophtographic apparatus according to claim 1, wherein said electrically conductive material having a three-dimensional net structure is a foamed metal.

4. A liquid electrophotographic apparatus, comprising:

a developing electrode in opposing and spaced-apart relationship with a first surface of a photoconductive material upon which is formed an electrostatic latent image;

a back electrode which is brought into contact with a second surface opposite to said first surface of said photoconductive material disposed in opposing relation to said developing electrode, and made of an electrically conductive material having a three-dimensional net structure, whose portions in contact with said second surface of said photoconductive material define a macroscopically flat surface;

a frame structure for supporting said back electrode; and an attachment means for detachably attaching said back electrode to said frame structure.

5. A liquid electrophotographic apparatus according to claim 4, further comprising a feed means for feeding said photoconductive material between said developing and back electrodes; and a guide means disposed on the side of said frame structure on which said photoconductive material is fed, for guiding a transported photoconductive material between said developing and back electrodes.

6. A liquid electrophotographic apparatus according to claim 5, wherein said guide means is made of an electrically conductive material having a three-dimensional net structure and is integral with said back electrode.

7. A liquid electrophotographic apparatus according to claim 5, wherein the thickness of said guide means progressively decreases toward the edges thereof on the side of the photoconductive material inlet.

8. A liquid electrophotographic apparatus as set forth in claim 5, wherein said guide means is equipped with a toner supply means for supplying a liquid toner to said first surface of said photoconductive material passing through said guide means.

* * * * *